US011560895B2

(12) United States Patent
Choi et al.

(10) Patent No.: US 11,560,895 B2
(45) Date of Patent: Jan. 24, 2023

(54) LAUNDRY TREATING MACHINE

(71) Applicant: LG ELECTRONICS INC., Seoul (KR)

(72) Inventors: Hoon Choi, Seoul (KR); Donggi Shin, Seoul (KR); Jeongkeun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 414 days.

(21) Appl. No.: 16/769,457

(22) PCT Filed: Dec. 4, 2018

(86) PCT No.: PCT/KR2018/015238
§ 371 (c)(1),
(2) Date: Jun. 3, 2020

(87) PCT Pub. No.: WO2019/112286
PCT Pub. Date: Jun. 13, 2019

(65) Prior Publication Data

US 2020/0385914 A1 Dec. 10, 2020

(30) Foreign Application Priority Data

Dec. 4, 2017 (KR) ..... 10-2017-0165375

(51) Int. Cl.
*F04D 13/06* (2006.01)
*D06F 34/10* (2020.01)
(Continued)

(52) U.S. Cl.
CPC ..... *F04D 13/06* (2013.01); *D06F 23/04* (2013.01); *D06F 34/10* (2020.02); *D06F 37/42* (2013.01);
(Continued)

(58) Field of Classification Search
CPC ..... F04D 13/06
See application file for complete search history.

(56) References Cited

U.S. PATENT DOCUMENTS

2012/0183421 A1* 7/2012 Kim ..... H02K 7/14 310/88
2013/0074554 A1 3/2013 Chun et al.
(Continued)

FOREIGN PATENT DOCUMENTS

CN 1465798 1/2004
CN 101299551 11/2008
(Continued)

OTHER PUBLICATIONS

International Search Report dated Mar. 29, 2019 issued in Application No. PCT/KR2018/015238.
(Continued)

*Primary Examiner* — Jason Y Ko
(74) *Attorney, Agent, or Firm* — Ked & Associates

(57) ABSTRACT

A laundry treating machine includes a case, a tub, a drum, a drain pump housing, and a drain pump motor, wherein a plurality of fastening protrusions that are formed at one of the drain pump housing and the drain pump motor are inserted into a plurality of fastening grooves that are formed at the other of the drain pump housing and the drain pump motor, and wherein a length of one fastening protrusion is formed to be different from lengths of the other fastening protrusion such that the drain pump housing and the drain pump motor is prevented from being assembled wrongly.

11 Claims, 10 Drawing Sheets

(51) Int. Cl.

| | |
|---|---|
| ***D06F 23/04*** | (2006.01) |
| ***D06F 39/08*** | (2006.01) |
| ***F04D 29/42*** | (2006.01) |
| ***D06F 37/42*** | (2006.01) |

(52) U.S. Cl.
CPC ..... *D06F 39/08* (2013.01); *D06F 39/085* (2013.01); *F04D 29/426* (2013.01)

(56) References Cited

U.S. PATENT DOCUMENTS

| | | | |
|---|---|---|---|
| 2014/0238089 | A1 | 8/2014 | Jeong et al. |
| 2017/0298960 | A1 | 10/2017 | Li et al. |

FOREIGN PATENT DOCUMENTS

| | | |
|---|---|---|
| CN | 103958997 | 7/2014 |
| CN | 106958126 | 7/2017 |
| JP | 2017-207059 | 11/2017 |
| KR | 10-1999-0070177 | 9/1999 |
| KR | 10-2013-0034311 | 4/2013 |
| KR | 10-1626896 | 6/2016 |
| KR | 10-2017-0089709 | 8/2017 |

OTHER PUBLICATIONS

Chinese Office Action dated Apr. 25, 2022 issued in Application No. 201880088567.5 (English translation attached).

* cited by examiner

【FIG. 1】
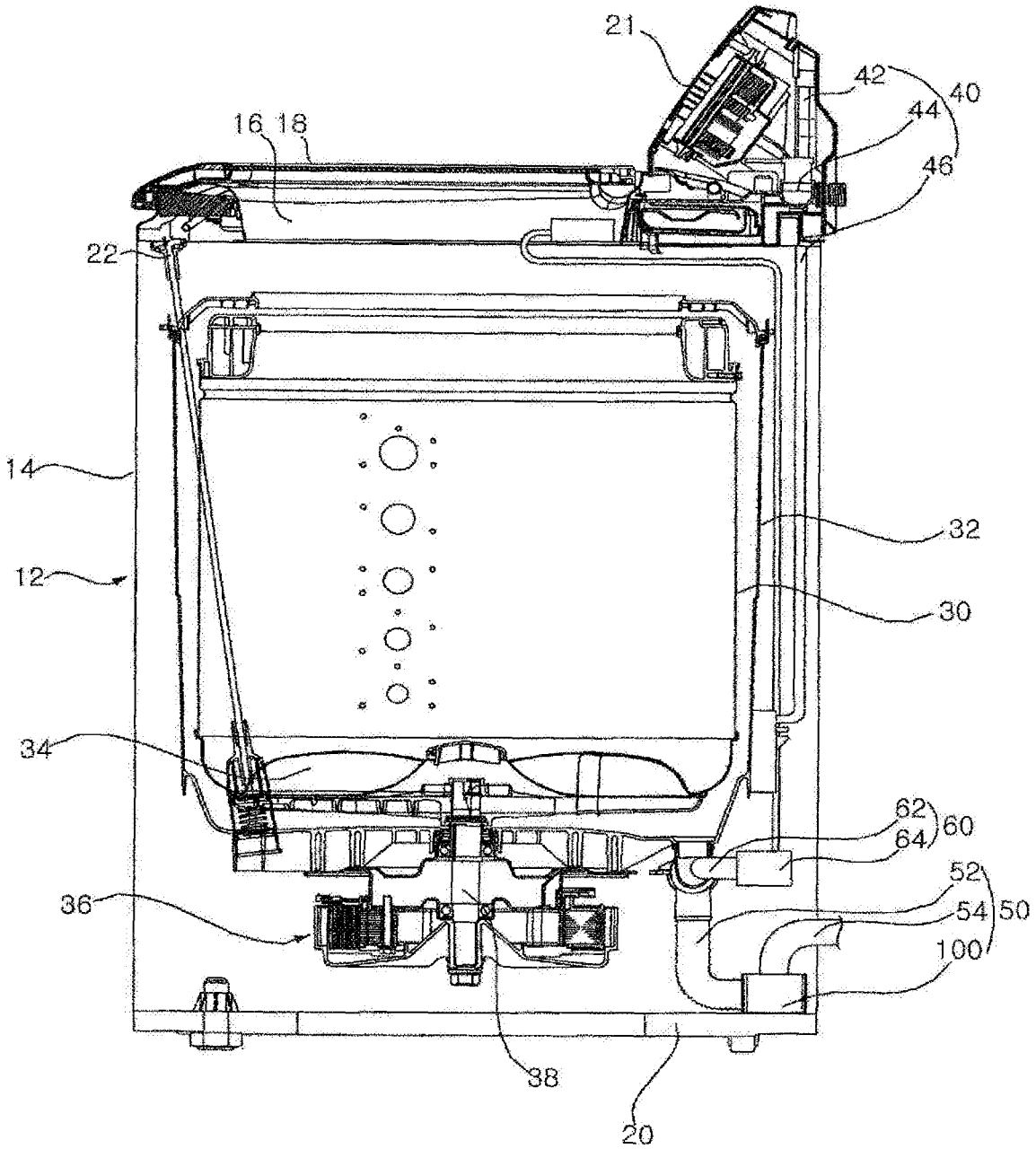

【FIG. 2】
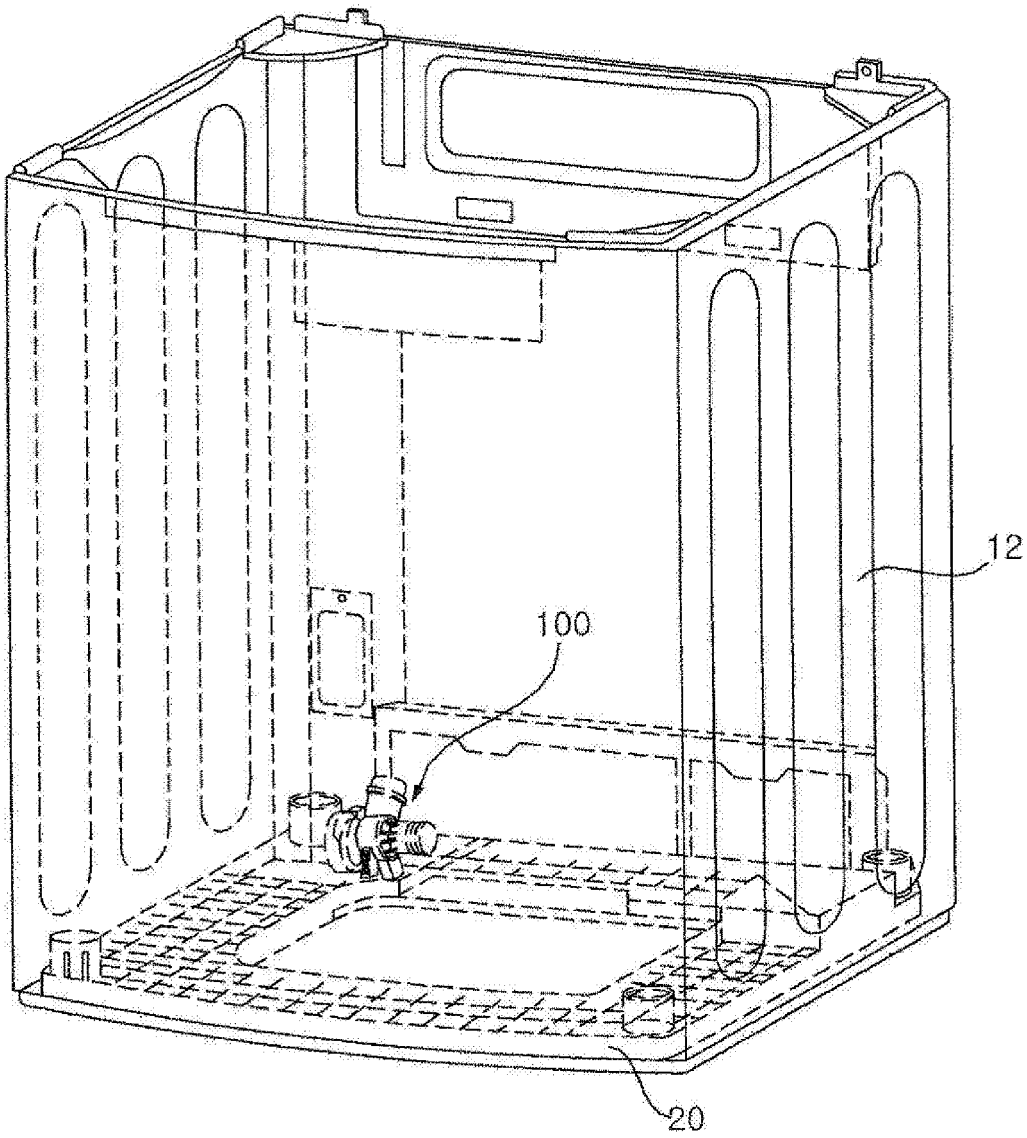

【FIG. 3】
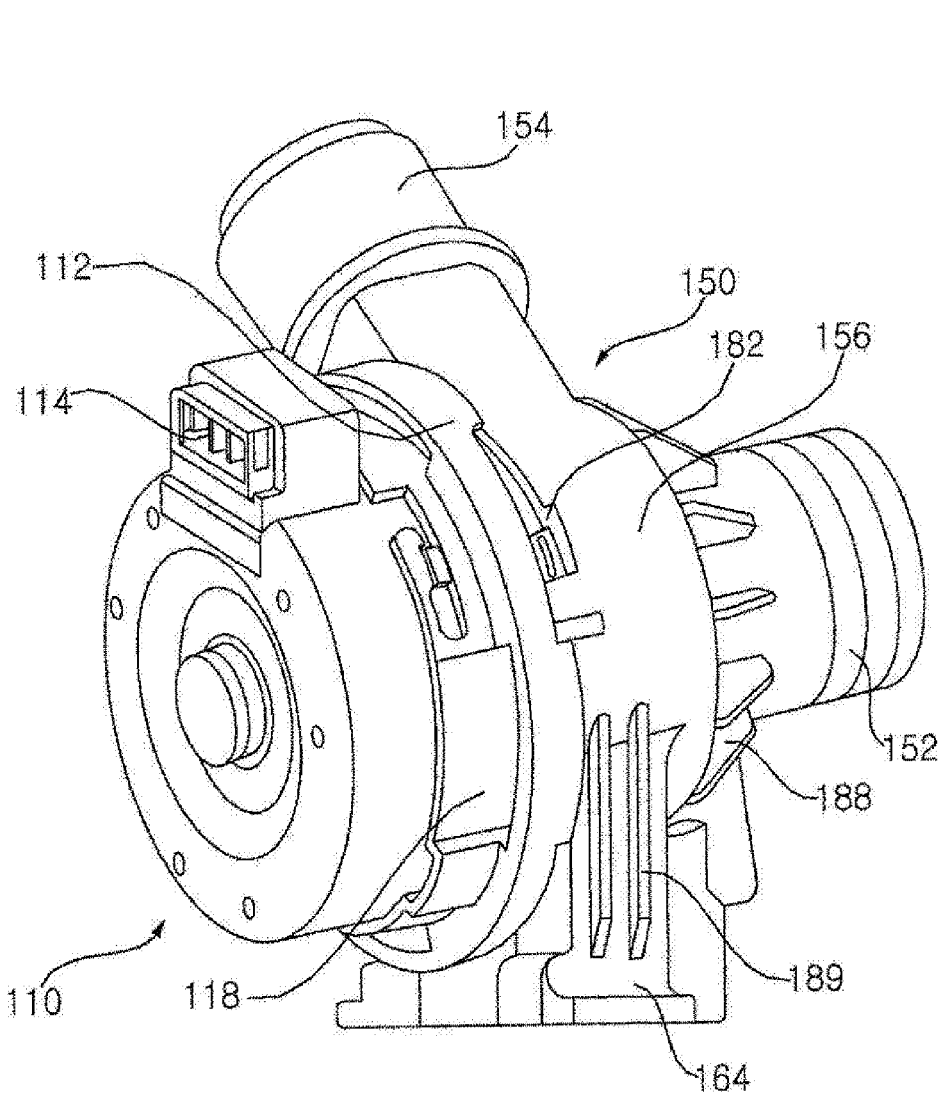

【FIG. 4】
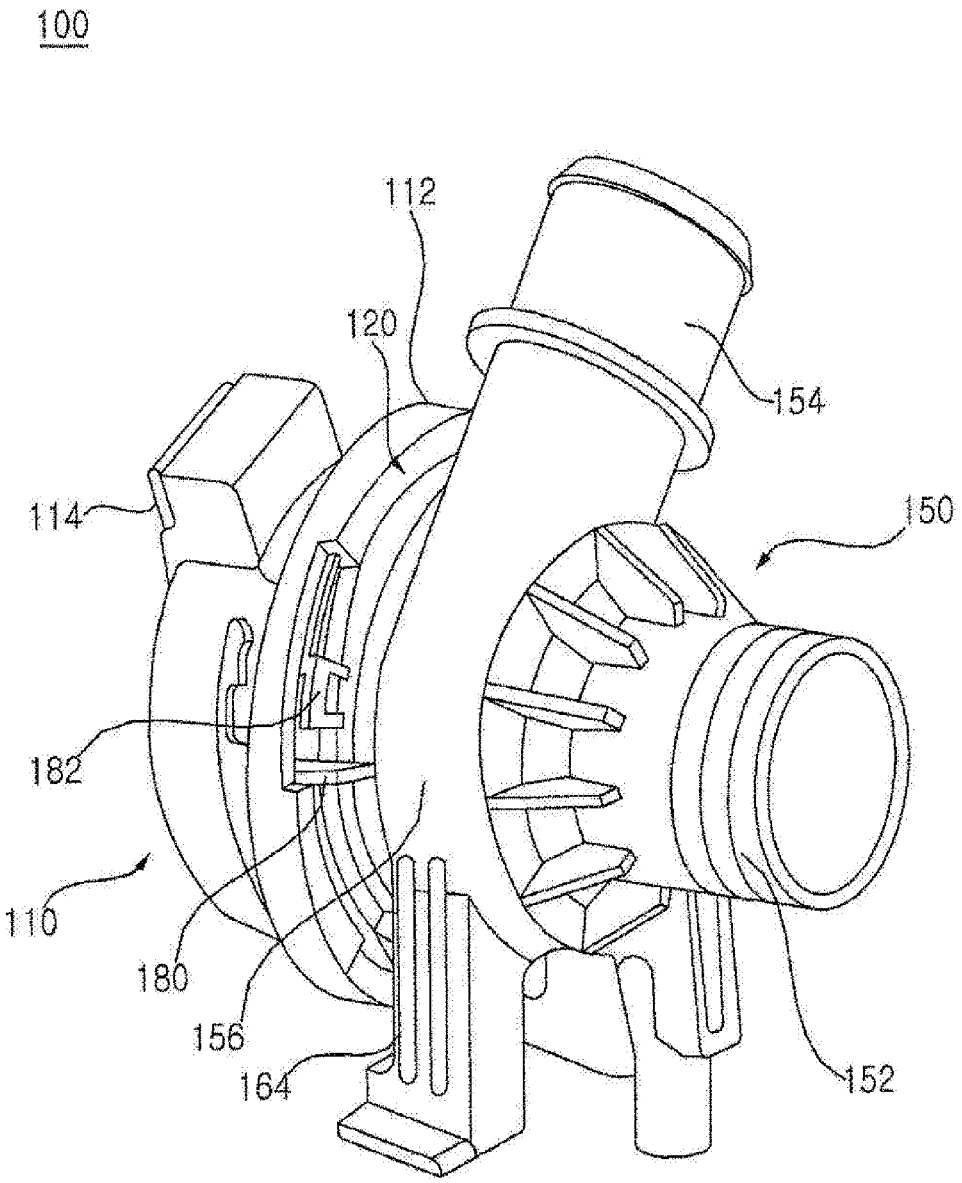

【FIG. 5】
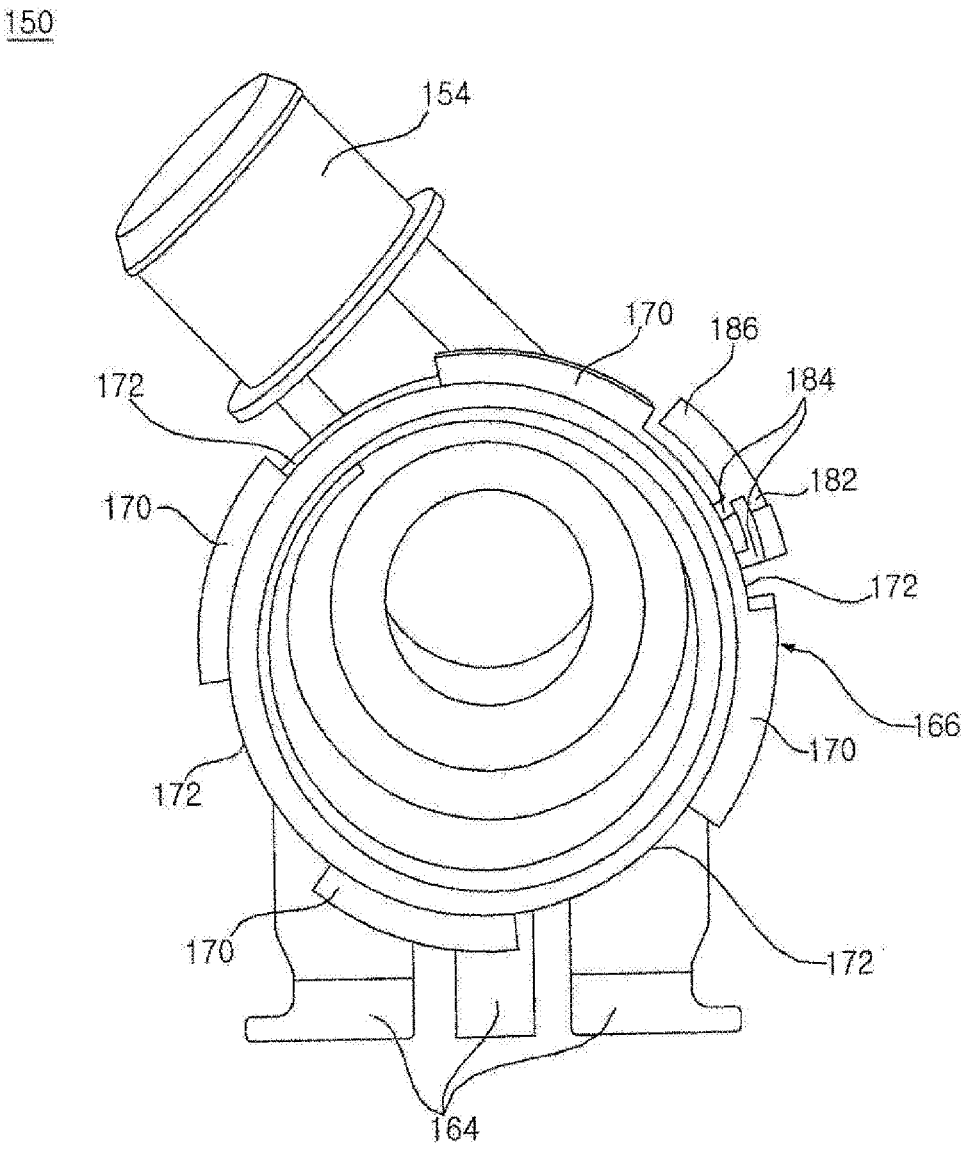

【FIG. 6】
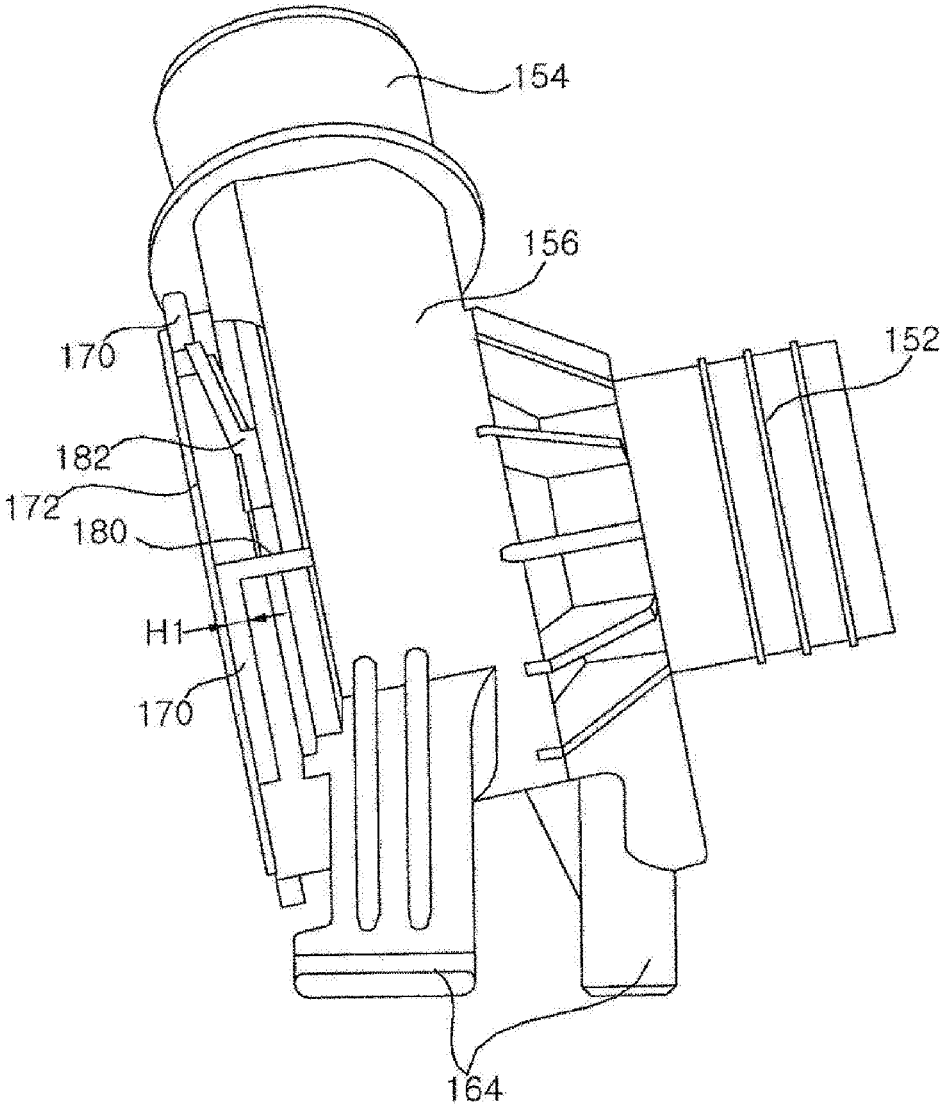

【FIG. 7】
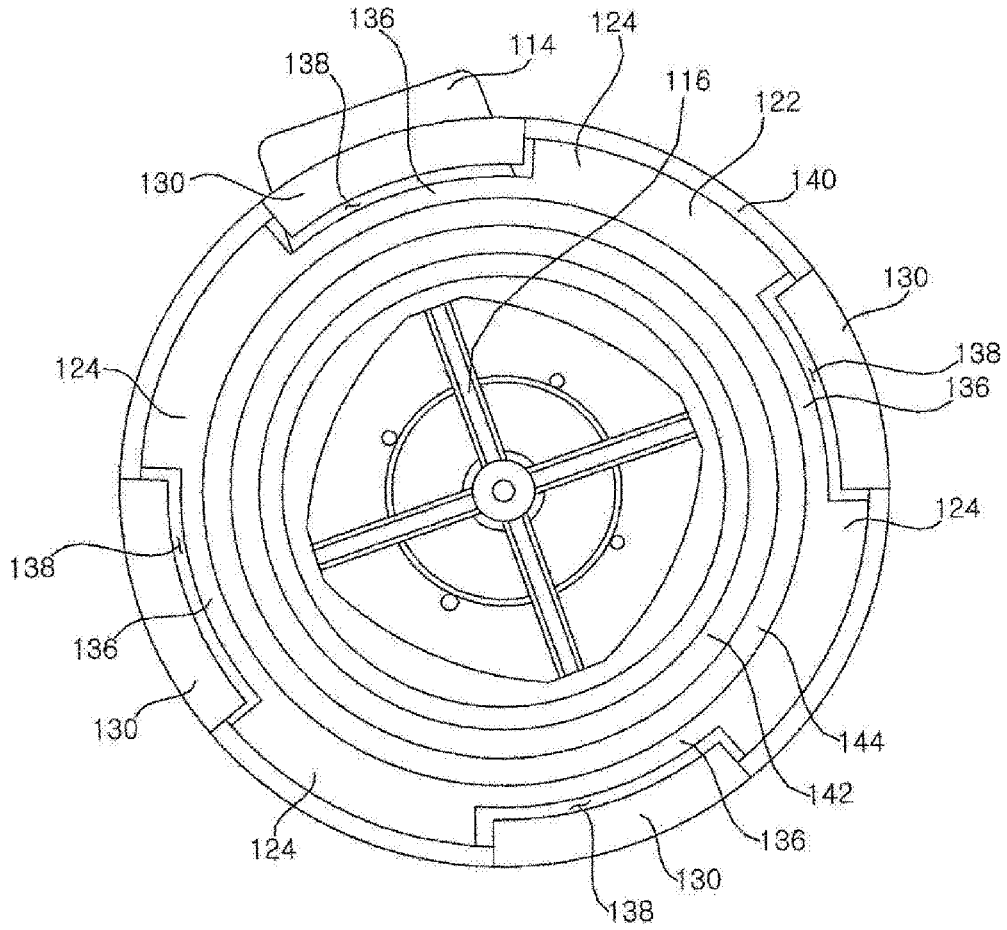

【FIG. 8】
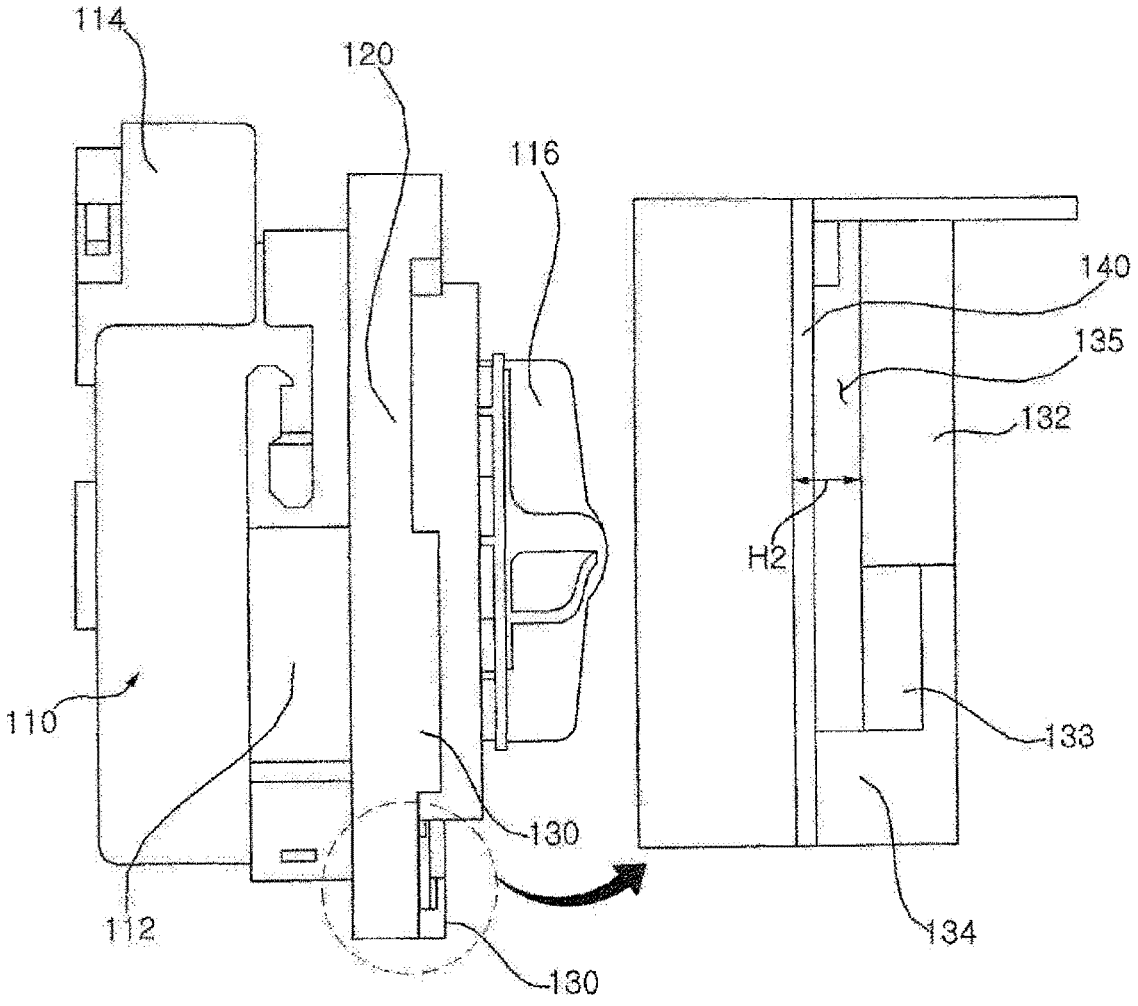

【FIG. 9】
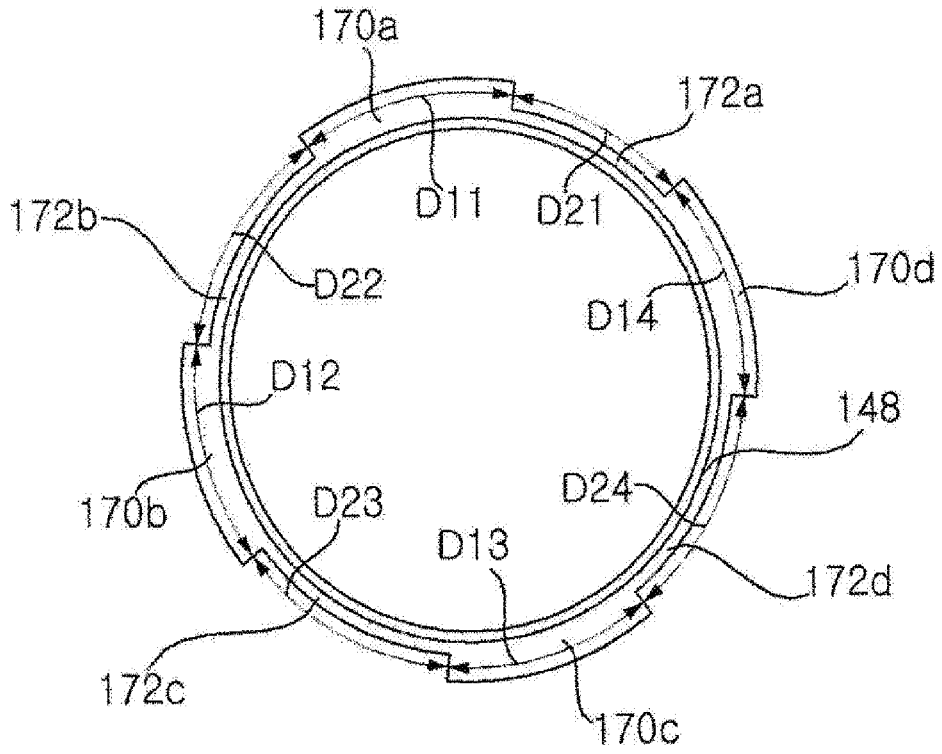

【FIG. 10】
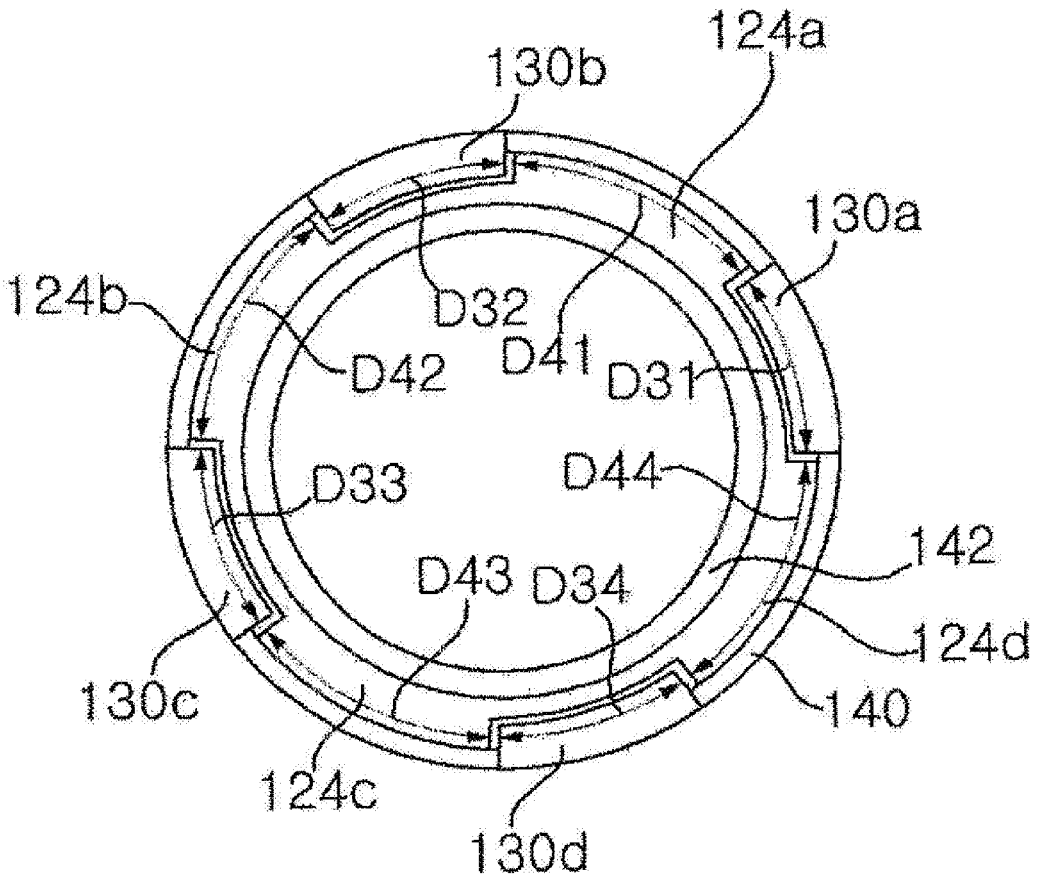

LAUNDRY TREATING MACHINE

CROSS-REFERENCE TO RELATED PATENT APPLICATIONS

This application is a U.S. National Stage Application under 35 U.S.C. § 371 of PCT Application No. PCT/KR2018/015238, filed Dec. 4, 2018, which claims priority to Korean Patent Application No. 10-2017-0165375, filed Dec. 4, 2017, whose entire disclosures are hereby incorporated by reference.

TECHNICAL FIELD

The present invention relates to a laundry treating machine, and more particularly to a laundry treating machine for preventing a drain pump from being wrongly assembled.

BACKGROUND ART

In general, a laundry treating machine is a device that washes laundry by rotating a cylindrical shaped drum containing laundry and wash water therein. There are two types of the laundry machines. One is a front loading type washing machine of which a drum is disposed horizontally, and when the drum is rotating in a forward and reverse directions with respect to a horizontal axis, the laundry is raised upside and dropped along the inner circumferential surface of the drum. Another is a top-loading type washing machine which washes laundry by water flow generated when a pulsator disposed in a drum is rotating in the forward and reverse directions, wherein the drum is disposed in a vertical direction.

Most generic laundry treating machine comprises a cabinet that forms the exterior appearance, a cylindrical tub that contains washing water and is disposed in the cabinet, and a drum that rotatably disposed inside of the tub, and washes laundry put in the drum by rotating the drum. This laundry treating machine comprises a water supply-system for supplying washing water and a drainage system for draining washing water after washing laundry is finished. The drainage system includes a drain hose to washing water outside and a drain pump that is located in the lower part of a water tank and generates power for pumping wash water to be drained.

The drain pump is located in the lower part of the tub and drains the water discharged from the tub. An electric power is supplied to the drain pump from a terminal and drives drain pump motor. However, a lower space of the laundry treating machine may be sunk under water in case that water is spilling over the laundry treating machine. Therefore, it is desired that the terminal that supplies the electric power from off-site is placed on an upper side of the drain pump motor to prevent an electric shock.

When fastening means, that fastens the drain pump motor where a terminal is installed and the drain pump housing where drained water flows, simply performs the function of fastening without being arranged in a predetermined position, the arrangement of the terminal could be changed in the process of fastening the drain pump motor and drain pump housing, and in some cases, the problem that the terminal is placed in the lower part of the drain pump motor may be occurred.

DISCLOSURE

Technical Problem

The present invention has been made in view of the above problems, and an object of the present invention is to provide a laundry treating machine that minimizes damage when a terminal of the drain pump motor is sunk into watching water or washing water is overflowed.

The present invention aims to provide the laundry treating machine having the structure that the terminal of the drain pump that has usually placed in a lower part of the machine is placed in an upper part of the machine as high as possible.

For the structure such that the terminal of drain pump is placed in the upper part, the present invention aims to provide the laundry treating machine that prevents from being wrong assembled when combining a drain pump housing and a drain pump motor including the terminal.

To prevent wrong assembly of the drain pump motor and the drain pump housing, the present invention aims to provide the laundry treating machine where the drain pump motor and the drain pump housing are fastened to each other at a predetermined position.

To secure that the drain pump motor and the drain pump housing are fastened to each other at the predetermined position, the present invention aims to provide the laundry treating machine with the structure that drain pump motor and drain pump housing are not fastened to each other at an other position different from the predetermined position.

The objects of the present invention are not limited to the objects mentioned above and other objects that are not mentioned will be understood by a person skilled in the art as described below.

Technical Solution

In accordance with the present disclosure, the above objects can be accomplished by the providing a laundry treating machine including a case, a tub disposed in the case for containing washing water, a drum rotatably disposed in the tub, a drain pump housing, and a drain pump motor, wherein the drain pump housing and the drain pump motor are fastened to each other, wherein a plurality of fastening protrusions formed at one of the drain pump housing and the drain pump motor are inserted into a plurality of fastening grooves formed at the other of the drain pump housing and the drain pump motor, and wherein a length of one of the plurality of fastening protrusions in an extended directions of the fastening protrusions is different from lengths of the other fastening protrusions, or a length of one space between two neighboring fastenings is different from lengths of the other spaces between the other two neighboring fastenings.

The drain pump housing may includes an inlet pipe through which washing water in the tub is introduced, an outlet pipe through which washing water is drained to an outside, a housing body that connects the inlet pipe and the outlet pipe, and has an opening at a front side thereof to which the drain pump motor is connected, and the plurality of fastening protrusions protruded outward in a radial direction along an outer circumference of the opened front side of the housing body.

A plurality of protrusion grooves of the housing body may be formed between the plurality of fastening protrusions at the housing body, without protruding outward in radial direction from the outer circumference of the opened front side and, a length of one protrusion groove of the plurality of protrusion grooves formed along the outer circumference of the housing body may be formed to be different from lengths of the other protrusion grooves.

The drain pump housing may includes a first stopper that limits rotation of the fastening protrusion in a direction of inserting the fastening protrusion into the fastening groove by touching one edge of the fastening groove, and a second stopper that limits rotation of the fastening protrusion in direction of releasing the fastening protrusion from the fastening groove by touching the other edge of the fastening groove.

The drain pump motor may include an impeller that rotates to discharge washing water flowing in the drain pump housing to the outside, and a terminal that connects to a power line to receive an external power, wherein the terminal is placed on an upper part of the drain pump motor when the drain pump motor and the drain pump housing are fastened to each other.

The drain pump housing may include a housing body that connects an inlet pipe and the outlet pipe, and has an opening at a front side of the housing body to which the drain pump motor is connected, wherein the plurality of the fastening protrusions are formed at the housing body to be protruded outward in a radial direction along an outer circumference of an opened front side of the housing body, and a plurality of protrusion grooves are formed between the plurality of fastening protrusions without being protruded outward in the radial direction from the outer circumference of the opened front side of the housing body.

The drain pump motor may include a plurality of seat portions on which the plurality of fastening protrusions are seated, wherein the plurality of fastening grooves are formed at the drain pump motor, wherein the plurality of protrusion grooves are seated on and the plurality of the fastening protrusions are inserted into the plurality of the fastening grooves.

A length of one of the protrusion grooves may be different from lengths of the other protrusion grooves, wherein the length is a length of a protrusion groove formed along the circumference of the housing body, and each of the plurality of fastening grooves may be formed to have a length such that a corresponding protrusion groove can be seated on.

A thickness of one of the fastening protrusions may be different from thicknesses of the other fastening protrusions, and each of the plurality of fastening grooves may be formed to have the thickness such that a corresponding fastening protrusion is inserted into a corresponding fastening groove.

The laundry treating machine that includes a case, a tub disposed in the case for containing washing water, a drum rotatably disposed in the tub, a drain pump housing configured to allow washing water drained from the tub to flow therethrough, a drain pump motor that causes washing water in the drain pump housing to flow, and a terminal placed at a side of the drain pump motor to receive an external power, wherein the drain pump housing and the drain pump motor are fastened to each other, wherein a plurality of fastening protrusions are formed at one of the drain pump housing and the drain pump motor are inserted into a plurality of fastening grooves formed at the other of the drain pump housing and the drain pump motor, wherein the plurality of fastening protrusions and the plurality of fastening grooves are formed such that each of the fastening protrusions is inserted into a corresponding fastening groove to place the terminal in a predetermined position when the drain pump motor and the drain pump housing are fastened to each other.

The plurality of seat portions on which the plurality of fastening protrusions are seated are formed between the plurality of fastening grooves, and the plurality of fastening protrusions and the plurality of seat portions are formed such that each of fastening protrusions is seated on a predetermined seat portion.

All the other details of the embodiments is disclosed in the description and drawings.

Advantageous Effects

The present disclosure of the laundry treating machine has one or more effects herein below.

First, the present disclosure has an advantage that prevents wrong assembly of the drain pump motor and the drain pump housing as each of the plurality of fastening protrusions is inserted into the corresponding fastening groove such that the position where the drain pump motor and the drain pump housing are fastened is constant.

Second, the present disclosure has an advantage that prevents wrong installation of the drain pump motor and the drain pump housing in advance as the fastening grooves on which the plurality of protrusion grooves are seated are formed in separate.

Third, the present disclosure has an advantage that damage of the laundry treating machine can be minimized when washing water is over flooded or over spilled as the terminal is placed on the upper part of the machine when the drain pump housing and the drain pump motor are fastened to each other.

The effects of the present invention are not limited to the effects mentioned above and the other effects that are not mentioned above are described in the claims and they will be clearly understood by a person skilled in the art.

DESCRIPTION OF DRAWINGS

FIG. 1 is a drawing to explain the structure of a laundry treating machine according to an embodiment of the present disclosure.

FIG. 2 is a drawing to explain the arrangement of the drain pump of a laundry treating machine according to an embodiment of the present disclosure.

FIG. 3 is a perspective view of a drain pump of a laundry treating machine according to an embodiment of the present disclosure.

FIG. 4 is a rear perspective view of a drain pump of a laundry treating machine according to an embodiment of the present disclosure.

FIG. 5 is a front view of a drain pump housing of a laundry treating machine according to an embodiment of the present disclosure.

FIG. 6 is a side view of a drain pump housing of a laundry treating machine according to an embodiment of the present disclosure.

FIG. 7 is a front view of a drain pump motor of a laundry treating machine according to an embodiment of the present disclosure.

FIG. 8 is a side view of a drain pump motor of a laundry treating machine according to an embodiment of the present disclosure.

FIG. 9 is a drawing of a housing fastening portion of a drain pump housing of a laundry treating machine according to an embodiment of the present disclosure.

FIG. 10 is a drawing of a motor fastening portion of a drain pump motor of a laundry treating machine according to an embodiment of the present disclosure.

BEST MODE

Advantages, characteristics and how to accomplish them of the present invention will become clear when referring to embodiments that have attached drawings with detailed descriptions of the drawings that are written in the other pages. However, the present invention is not limited to the embodiments that are disclosed below and it can be implemented in many other different forms. Simply, the present embodiments make the disclosure of the present invention complete, the embodiments are provided to inform the category of the invention completely to the person of ordinary skill in the pertinent field that covers the present invention and the present invention is defined only by the claim. An identical referential mark refers to an identical component all over the specification.

The present invention will be explained referring to the drawings for explaining the laundry treating machine through the embodiments of the present invention as below.

FIG. 1 is a drawing to explain the structure of a laundry treating machine according to the present disclosure. FIG. 2 is a drawing to explain the arrangement of the drain pump of a laundry treating machine according to the present disclosure.

The composition of a laundry treating machine according to the present disclosure will be explained referring to the FIG. 1 and FIG. 2 below.

Referring to FIG. 1, a laundry treating machine (10) according to the present disclosure is a top loading type laundry treating machine (10) that laundry is input from an upward direction into a drum. This top loading laundry treating machine (10) includes a washing machine that performs washing, rinsing and spin drying when laundry is input in the drum or a dryer that performs drying when wet laundry is input in a drum, Herein below it will be written focusing on the washing machine (10).

The laundry treating machine (10) according to the present disclosure includes a case (12) that forms an external appearance, a base (20) that is disposed at an opened lower part of the case (12), and a door (18) that is rotatably attached on the case which can be opened and closed so that an user can input or take out laundry.

The case (12) is formed with the structure that an upper part and a lower part are opened and includes a cabinet (14) that forms the side of the machine and a top cover (16) that is installed to cover the opened upper part of the cabinet (14).

The door (18) makes open or close an entrance of laundry of the top cover (16). At least a part of the door (18) is formed with a glass so that an inside of the machine is visible.

The laundry treating machine (10) includes control keys that an user can input control instruction and a control panel (21) that provides an user interface as it has a display that shows a status of the operation. The control panel (21) can be equipped on a part of a top cover (16).

The laundry treating machine (10) has a tub (32) that contains washing water and a drum (30) that is rotatably disposed in the tub (32), and accommodates washing water. A balancer is equipped in the upper part of the drum (30) to reward eccentricity that occurs when the drum (30) is rotating. The laundry treating machine (10) includes a pulsator (34) that generates rotation flow of washing water accommodated in the tub (32). The pulsator (34) is placed at the bottom of the drum (30).

The laundry treating machine (10) according to the present disclosure includes a driving apparatus that provides driving power for rotating the drum (30) and/or the pulsator (34), a rotation shaft (38) that transmits driving power from the driving apparatus (36) to the drum (30) or the pulsator (34). The laundry treating machine (10) according to the present disclosure may additionally include a clutch motor (not illustrated) that makes only the drum (30) to rotate or makes only the pulsator (34) to rotate or makes the drum and the pulsator (34) to rotate at the same time as it selectively transmits driving power from the driving apparatus (36).

The clutch motor is driven to move a coupling in order to rotate the pulsator (34) or the drum (30).

The laundry treating machine includes a plurality of suspensions (22) that suspend the tub (32) on an upper part of an inside of the cabinet (14). One edge of the suspension (22) is combined to the upper part of the inside of the cabinet (14) and the other edge is combined to a bottom of the tub (32). It is possible that the suspension (22) is combined to the top cover (16) that is one of components of the case. However, it is not the only way, and combining it to any fixed part of the case (12) is possible.

The laundry treating machine (10) according to the present disclosure includes a water supply assembly (40) that provides washing water into the tub (32), a drain assembly (50) that drains washing water from the tub (32) after washing or spin-drying is completed, and a circulation assembly (60) that circulates washing water in the tub (32) into the drum (30), not draining the washing water outside.

The water supply assembly (40) includes an external hose (42) through which washing water is supplied from an external tap, et al to the above laundry washing machine (10), a water supply valve (44) that connects to the external hose (42) and adjusts water supply, and a water supply hose (46) that connects the water supply valve (44) and a diffuser. The water supply valve (44) and the water supply hose (46) form a water supply channel that supplies washing water.

The drain assembly (50) is formed at the bottom of the tub (32) and includes a drain hose (52, 54) that forms a drain channel, and a drain pump (100) that pumps washing water that is following in the drain channel to an outside.

The drain assembly (50) is placed between the tub (32) and the base (20). The drain hose includes a first drain hose (52) that connects to the tub (32) and the drain pump (100) and a second drain hose (54) that discharges washing water that is drained from the drain pump (100) to the outside.

The circulation assembly (60) includes a circulation hose (62) that forms a circulation channel that is formed to circulate washing water in the tub (32) into the drum (30), not discharging washing water outside when washing or rinsing, and a circulation pump (not illustrated) that is placed on the above circulation channel and pumps washing water. The circulation assembly (60) is placed between the tub (32) and the cabinet (14).

FIG. 3 is a perspective view of the drain pump of the laundry treating machine according to the present disclosure. FIG. 4 is a rear perspective view of the drain pump of the laundry treating machine according to the present disclosure. FIG. 5 is a front view of the drain pump housing of the laundry treating machine according to the present disclosure. FIG. 6 is a side view of the drain pump housing of the laundry treating machine according to the present disclosure. FIG. 7 is a front view of the drain pump motor of the laundry treating machine according to the present disclosure. FIG. 8 is a side view of the drain pump motor of the laundry treating machine according to the present disclosure. FIG. 9 is a drawing of a fastening portion of the drain pump housing of the laundry treating machine according to the present disclosure. FIG. 10 is a drawing of a fastening portion of the drain pump motor of the laundry treating machine according to the present disclosure.

The drain pump motor of the laundry treating machine according to the present disclosure will be described referring to from FIG. 3 to FIG. 10.

The drain pump (100) includes a drain pump motor (110) that pumps washing water drained from the tub (32) to an outside, and a drain pump housing (150) that connects to a first drain hose (52) and a second drain hose (54), and a drain pump housing (150) that is fixed to the base (20).

The drain pump housing (150) and the drain pump motor (110) can be fastened to each other by a plurality of fastening protrusions that are formed at one of the drain pump housing (150) and the drain pump motor (110) is inserted into a plurality of fastening grooves that are formed at the other of the drain pump housing (150) and the drain pump motor (110).

A length of extension of one of the plurality of fastening protrusions that is formed at one of the drain pump housing (150) and the drain pump motor (110) may be formed to be different from lengths of extensions of the other fastening protrusions. Also, a length of one space that is formed between two neighboring fastenings that are formed at one of the drain pump housing (150) and the drain pump motor (110) may be formed to be different from lengths of the other spaces that are formed between the other two neighboring fastenings.

The plurality of fastening protrusions and the plurality of fastening grooves may be formed to have structure that the terminal is placed in a predetermined position and each of fastening protrusions is inserted only into a corresponding fastening groove when the drain pump housing (150) and the drain pump motor (110) are fastened to each other. In other words, the terminal can be always arranged in regular position since the fastening grooves into which the plurality of fastening protrusions are inserted are predetermined when the drain pump housing (150) and the drain pump motor (110) are fastened.

Also, a plurality of seat portions on which the plurality of fastening grooves are seated on are formed between the plurality of fastening grooves and the plurality of fastening protrusions, and the plurality of seat portions are formed to have a structure such that each of fastening protrusions is seated on only a corresponding seat portion. In other words, it is a structure that they are fastened only in predetermined positions since they are seated on only in predetermined positions.

The drain pump housing (150) is combined with the drain pump motor (110) in a part. The drain pump housing (150) includes an inlet pipe (152) that is connected to a first drain hose (52) through which washing water in the tub (32) flows into the drain pump housing, an outlet pipe that is connected to a second drain hose (54) through which washing water is drained outside, housing body (156) that connects the inlet pipe (152) and the outlet pipe (154) and forms a space in which an impeller can be placed, a base fastening portion (164) that is extended from the housing body (156) and fixes the drain pump housing (150) to the base (20) and the housing fastening portion (166) that is protruded so that the drain pump housing (150) and the drain pump motor (110) are fastened to each other.

The housing body (156) may be formed in cylindrical shape and the inlet pipe may be formed along a central axis of the cylindrical shape. The outlet pipe (154) may be placed at a part of a circumference surface of the housing body.

The housing body (156) is provided with an opened front side that is confronting to the drain pump motor (110). An impeller of the drain pump motor (110) may be disposed at a part of the opened front side of the housing body (156).

A fastening portion (166) by which the drain pump motor and the drain pump housing are fastened to each other is placed in an outer circumference of the opened front side of the housing body (156).

The plurality of fastening protrusions (170) are protruded outward in a radial direction of the housing body (156) along the outer circumference of the opened front side of the housing body (156). The plurality of fastening protrusions (170) are protruded in the radial direction at the outer circumference of the opened front side of the housing body (156) and a protruding part is extended along the circumference. Height protruded in the radial direction from the circumstance of each of the plurality of fastening protrusions (170) is same, and the length extended along the circumstance of each of the plurality of fastening protrusions (170) may be different.

The housing fastening portion (166) includes the plurality of fastening protrusions (170) that protrude outward in the radial direction at the outer circumference of the opened front side, and the plurality of protrusion grooves (172) that are not protruded between the plurality of fastening protrusions (170) at an outer circumference of the opened front side. In the housing fastening portion (166), the fastening protrusions and the protrusion grooves are placed alternately along the outer circumference that is formed at the front side of the housing body (156).

The plurality of protrusion grooves (172) are not protruded outward in the radial direction at the outer circumference of the housing body (156) between the plurality of fastening protrusions (170) to be distinguished from the plurality of fastening protrusions (170). In other words, the plurality of protrusion grooves (172) are not protruded in the radial direction from the outer circumference of the housing body (156) and are portions to form grooves between each of fastening protrusions (170).

Referring to FIG. 9, the housing body (156) includes four fastening protrusions (170*a*, 170*b*, 170*c*, 170*d*) and four protrusion grooves. The housing body (156) includes a first fastening protrusion (170*a*), a second fastening protrusion (170*b*), a third fastening protrusion (170*c*) and a fourth fastening protrusion (170*d*), and a first protrusion groove (172*a*) to a fourth protrusion groove (172*d*) that are formed between the first fastening protrusion (170*a*) to the fourth fastening protrusion (170*d*).

A length of one protrusion groove (172) among the plurality of protrusion grooves (172) is formed differently from the lengths of the other protrusion grooves, wherein the length is formed along the circumference of the housing body (156). Referring to FIG. 9, a length of the first protrusion groove (172*a*) that is formed along the housing body (156) is different from a length of each of the second protrusion groove (172*b*) to the fourth protrusion groove (172*d*) that is formed along the housing body (156). The length of each of the second protrusion groove (172*b*), the third protrusion groove (172*c*) and the fourth protrusion groove (172*d*) that is formed along the housing body (156) may be different each other.

A length of one fastening protrusion (170) of the plurality of fastening protrusions (170) according to the other present disclosure is formed differently from lengths of the other fastening protrusions (170), wherein the length is a length extended extension along the circumference of the housing body (156). Lengths of at least two fastening protrusions (170) of the plurality of fastening protrusions (170) are formed differently in a length extended along the housing body (156). Referring to FIG. 9, a length (D11) of extension of the first fastening protrusion (170*a*) along the circumference of the housing body (156) is formed differently from a length (D12, D13, D14) of each of the second fastening protrusion (170*b*) to the fourth fastening protrusion (170*d*) that are extended along the circumference of the housing body. It is also possible that lengths of extension of each of the second fastening protrusion (170*b*) to the fourth fastening protrusion (170*d*) along the circumference of the housing body (156) are formed differently each other.

According to another present disclosure, it is also possible that a length of one fastening protrusion (170) of the plurality of fastening protrusions (170) is formed differently from the other fastening protrusions in a length of extension along the circumference of the housing body (156), and a length of one protrusion groove of the plurality of protrusion grooves (172) is formed differently from those of the other protrusion grooves (172), wherein a length that is formed along the circumference of the housing body (156). Referring to FIG. 9, the length (D11) of the first fastening protrusion (170*a*) that is protruded and extended along the outer circumference of the opened front side of the housing body (156) is different from lengths (D12, D13, D14) of the second fastening protrusion (170*b*) to the fourth fastening protrusion (170*d*) that are protruded and extended along the outer circumference. Also, the length of the first protrusion groove (172*a*) that is formed along the housing body (156) can be different from the length (D12, D13, D14) of each of the second protrusion groove (172*b*) to the fourth protrusion groove (172*d*) that are formed along the housing body (156).

The drain pump housing (150) includes a stopper that maintains the drain pump housing (150) and the drain pump motor (110) in a fastened state. The stopper is formed at an end portion of the fastening protrusion (170), and includes a first stopper (180) that prevents the fastening protrusion (170) from being rotated in an one-side direction of the fastening protrusion (170), a second stopper (182) that prevents the fastening protrusion (170) from being rotated in an opposite direction to the one-side of the fastening protrusion (170).

The first stopper (180) is vertically bended and extended at a part of the fastening protrusion (170). The first stopper (180) limits the rotation in a direction that the fastening protrusion (170) is inserted in the fastening groove (130).

The first stopper (180) is formed at each of the fastening protrusions (170). Therefore, the same number of first stoppers (180) as the plurality of fastening protrusions (170) may be formed.

The second stopper (182) protrudes in a radial direction between the fastening protrusion (170) and adjacent fastening protrusion. The second stopper (182) is protruded in a form of '⌉'. The second stopper (182) includes a supporting portion (184) that protrudes in the radial direction at the circumference of the housing body (156), and a hooking portion (186) that is vertically bent at an end portion of the supporting portion (184) and extended along the circumference of the housing body (156). The supporting portion (184) comprises more than two support portion for rigidity. Referring to FIG. 5, the hooking portion (186) is connected to at the end portion of each of two support portion. The hooking portion (186) is placed with a space apart from the circumference of the housing body (156). The hooking portion (186) is placed with a structure that slopes toward a front of the housing body (156).

A disposition of the hooking portion (186) may be changed in a front-rear direction of the housing body (156) by elasticity within a certain range. Therefore, a pressure plate (132) of the fastening groove (130) that will be explained below put the pressure on the hooking portion (186) rearward so that the disposition of the hooking portion (186) may be changed when the drain pump housing (150) and the drain pump motor (110) are fastened to each other. After the drain pump housing (150) and the drain pump motor (110) are fastened, the disposition of the hooking portion (186) is maintained in its original position as the pressure plate (132) does not pressurize the hooking portion (186). After the drain pump housing (150) and the drain pump motor (110) are fastened, an end portion of the hooking portion (186) meets an end portion of the pressure plate (132), thereby the second stopper (182) limits the rotation in a reverse direction in which the fastening protrusion (170) is inserted into the fastening groove (130).

The second stopper (182) meets the other edge of the pressure plate (132) of fastening groove (130) when at least one of first stoppers (180) meets edge of the pressure plate (132) of the fastening groove (130).

Referring to FIG. 5, the second stopper (182) is placed at the circumference of the housing body (156). However, it is also possible that more than two second stoppers are disposed.

In the drain pump housing (150) according to the embodiment, a reinforcing rib (188) that reinforces rigidity is formed in a part that connects the housing body (156) and the inlet pipe (152). In the drain pump housing (150) according to the embodiment, a reinforcing rib (188) that reinforces rigidity is formed in a part that connects the housing body (156) and a base fastening portion (164).

The drain pump motor (110) is coupled to an one-side of the drain pump housing (150). The drain pump motor (110) drains washing water in the drain pump housing (150) to the outside.

The drain pump motor (110) includes an impeller (116) that rotates to drain water in a drain pump housing (150) to the outside. The impeller may rotate by a rotor (not illustrated) of the drain pump motor.

Referring to FIG. 3, the drain pump (100) according to the embodiment additionally includes a motor case (112) that fixes the drain pump motor (110) to the drain pump housing (150) as it is combined to an outer circumference of the drain pump motor (110). The motor case (112) is combined with the drain pump motor (110) at one-side and combined with the drain pump housing in the other-side.

It is also possible that the drain pump (100) according to the embodiment is formed as one body that includes both the drain pump motor (110) and the motor case (112). In this case, a separate motor case (112) is not necessary and the drain pump motor (110) can be directly fastened to the drain pump housing (150). The case that the fastening groove (130) formed at the drain pump motor (110) is directly fastened to the drain pump housing (150) will be explained below as an embodiment. However, in a case that the separate motor case (112) is used, a fastening groove can be formed at the motor case (112).

The drain pump motor (110) includes a terminal (114) that is provided with an external power. The terminal (114) according to the embodiment can be connected to a power line that is connected to the external power. The drain pump (100) according to the embodiment combines the drain pump housing (150) with the drain pump motor (110) so that the terminal (114) is placed on an upper part. When the drain pump housing (150) and the drain pump motor (110) are fastened the terminal (114) that is placed at the drain pump motor (110) is positioned on the upper part of the drain pump motor (110).

The drain pump motor (110) includes the motor fastening portion that is fastened to the drain pump housing (150). The motor fastening portion (120) includes a plurality of seat portions (124) on which the plurality of fastening protrusions (170) of the drain pump housing (150) are seated and the plurality of fastening grooves (130) into which the plurality of fastening protrusions (170) of the drain pump housing (150) are inserted as they are formed at the ends of the seat portions (124).

A plurality of fastening grooves (130) that are fastened to the drain pump housing (150) are formed at a drain pump motor (110). The drain pump motor (110) includes the plurality of seat portions (124) on which the plurality of fastening protrusions (170) of the drain pump housing (150) are seated, and the plurality of fastening grooves (130) into which the plurality of fastening protrusions (170) of the drain pump housing are inserted.

Referring to FIG. 10, the drain pump motor (110) includes four seat portions (124*a*, 124*b*, 124*c*, 124*d*) and four fastening grooves (130*a*, 130*b*, 130*c*, 130*d*). The drain pump motor (110) includes a first seat portion (124*a*) to a fourth seat portion (124*d*), and a first fastening groove (130*a*) to a fourth fastening groove (130*d*).

The drain pump motor (110) includes a fastening plate (122) onto which the plurality of fastening protrusions (170) are seated and fastened. The plurality of seat portions (124) onto which the plurality of fastening protrusions (170) are seated and the plurality of fastening grooves (130) into which the plurality of fastening protrusions (170) are inserted are formed at the above fastening plate (122).

The fastening groove (130) according to the embodiment is spaced apart from the fastening plate (122) or the seat portion (124). The fastening groove (130) according to the embodiment includes a pressure plate (132) that is spaced apart from the fastening plate (122) and a spacer (134) that separates the pressure plate (132) from the fastening plate (122). The fastening protrusion (170) is inserted into a space (135) that is formed between the pressure plate (132) and the fastening plate (122). A fastening protrusion groove (138) is formed at the fastening plate downward the fastening groove (130).

A length (H1) between the pressure plate (132) and the fastening plate (122) is formed to be smaller than a thickness (H2) of the fastening protrusion (170). Therefore, the drain pump motor (110) and the drain pump housing (150) can be fixed more strongly according as the pressure plate (132) put pressure on the fastening protrusion (170) downward when the fastening protrusion (170) is inserted in the fastening groove (130).

When the fastening protrusion (170) is inserted into the fastening groove (130), the fastening protrusion (170) can be elastically deformed in a direction of the fastening protrusion groove (138) by the pressure plate (132).

The pressure plate (132) includes a guide portion (133) that guides the fastening protrusion (170) towards a position that the fastening protrusion (170) is inserted into. The guide portion (133) according to the embodiment forms a slope surface at a bottom of the pressure plate (132). The guide portion (133) according to the embodiment is formed at an end portion of the pressure plate (132). The separated distance (H1) between the pressure plate (132) and the fastening plate (122) has to be same as a thickness (H2) of the fastening protrusion (170) at the guide portion (133) of the end portion of the pressure plate (132). Therefore, when the fastening protrusion (170) is inserted into the fastening groove (130), it can be naturally inserted into a space between the fastening plate (122) and the pressure plate (132).

A protrusion groove-seat portion (136) on which the protrusion groove (172) of the drain pump housing (150) is seated is formed between the pressure plate (132) and an inner circumference at the fastening plate (122) according to the embodiment. When the fastening protrusion (170) is seated on the seat portion (124), the protrusion groove (172) is seated on the protrusion groove-seat portion (136).

A corresponding fastening protrusion (170) is inserted into each of the plurality of fastening grooves (130) according to the embodiment. A corresponding protrusion groove (172) is seated on each of the plurality of protrusion groove-seat portions (136) according to the embodiment.

Each of the plurality of fastening protrusion (170) according to the embodiment is seated on a corresponding seat portion (124) and inserted into a corresponding fastening groove (130). The position at which the drain pump motor (110) and the drain pump housing (150) are fastened is determined so that when the drain pump motor (110) and the drain pump housing (150) are fastened, the terminal (114) is placed at an upper part.

One fastening groove (130) among the plurality of fastening grooves (130) according to the embodiment is formed to have a length different from lengths of the other fastening grooves (130), herein the length is formed along the circumference of the fastening plate (122) of the drain pump motor (110). The seat portion (124) of the plurality of seat portions according to the embodiment may be formed to have a length different from lengths of the other seat portions (124), wherein the length of a part is not protruded and formed along the circumference of the fastening plate of the drain pump motor (110).

Each of the plurality of fastening grooves (130) according to the embodiment is formed to have the length such that a corresponding protrusion groove (172) can be seated on. Each of the plurality of seat portions (124) according to the embodiment is formed to have the length such that a corresponding fastening protrusion (170) can be seated on.

Referring to FIGS. 9 and 10, length (D31, D32, D33, D34) of each of the first fastening groove (130*a*) to the fourth fastening groove (130*d*) that are formed along the circumference of the fastening plate (122) are formed to be corresponding to length (D11, D12, D13, D14) of each of the first protrusion (172*a*) groove to the fourth protrusion groove (172*d*). Here, the corresponding length means the length of each of the first protrusion groove (172*a*) to the fourth protrusion groove (172*d*) can be seated on corresponding one of the first fastening groove (130*a*) to the fourth fastening groove (130*d*), even though the length (D21) of the first protrusion groove (172*a*) formed along the housing body (156) is different from lengths (D22, D23, D24) of the other of the second protrusion groove (172*b*) to the fourth protrusion groove (172*d*) formed along the housing body (156). It a size of corresponding protrusion groove is different form a size of corresponding fastening groove, the drain pump motor (110) cannot be seated on the drain pump housing, thereby the drain pump motor (110) cannot be fastened to the drain pump housing (150).

Furthermore, referring to a FIG. 9 and FIG. 10, the length (D41, D42, D43, D44) of each of the first seat portion (124*a*) to the fourth seat portion (124*d*) formed along the fastening plate (122) is formed to be same as the length of a corresponding one (D11, D12, D13, D14) of the first fastening groove (170*a*) to the fourth fastening groove (170*d*) extended along the circumference of the housing body (156). Therefore, each of the first fastening (170*a*) to the fourth fastening (170*d*) is seated on each of the first seat portion to the fourth seat portion so that the drain pump motor (110) can be fastened to the drain pump housing (150).

The fastening plate (122) according to the embodiment includes an outer circumference guide (140) and an inner circumference guide (142) that guides a rotation of the fastening protrusion (170) of the drain pump housing (150). The outer circumference guide (140) meets the outer circumference of the plurality of fastening protrusions (170) when the fastening protrusions (170) of the drain pump housing are seated on the seat portions (124) of the drain pump motor (110). The inner circumference guide (142) according to the embodiment can meet an inner side of an outer circumference of an opened front side of the housing body (156) when the fastening protrusions (170) of the drain pump housing (150) are seated on the seat portions (124) of the drain pump motor (110).

Also, the drain pump motor (110) can additionally include a sealer (144) that prevents a leak of washing water flowing in the drain pump (110) from a part between the drain pump motor (110) and the drain pump housing (150). The sealer (144) can be placed at a circumference of outside of the inner circumference guide (144). The sealer (144) can be placed between the inner circumference guide (142) and an inner side of an outer circumference of the opened front side of the housing body (156).

Thickness of one fastening protrusion (H1, FIG. 6) of the plurality of fastening protrusions (170) formed at the drain pump housing (150) according to the other embodiment of the present invention may be formed to be different from thickness of the other fastening protrusions (170). In this case, thickness (H2, FIG. 8) of a inserting space of the fastening groove (130) corresponding to each of the plurality of fastening protrusions (170) is formed such that the corresponding fastening protrusion (170) can be inserted into.

Preferred embodiments of the present invention are illustrated and explained above, but the present invention is not limited to certain embodiments that are written above. Also, it is possible to perform modified implementation with many different forms by a person skilled in the relevant field of technology without having gone off the point of the present invention that suggests in a range of the patent claims and these modified implementations should not be understood individually based on the technological outlook or idea of the present invention.

[Description of Reference Symbols]

| | |
|---|---|
| 10: a laundry treating machine | 12: case |
| 18: door | 20: base |
| 30: drum | 32: tub |
| 34: pulsator | 36: driving apparatus |
| 40: water supply assembly | 50: drain assembly |
| 60: circulation assembly | 100: drain pump |
| 110: drain pump motor | 114: terminal |
| 116: impeller | 124: seat portion |
| 130: fastening groove | 132: pressure plate |
| 134: spacer | 138: fastening groove |
| 140: outer circumference guide | 142: inner circumference guide |
| 150: drain pump housing | 156: housing body |
| 164: base fastening portion | 170: fastening protrusion |
| 172: protrusion groove | 180: first stopper |
| 184: second stopper | |

The invention claimed is:

1. A laundry treating machine comprising:

a case;

a tub disposed in the case for containing washing water;

a drum rotatably disposed in the tub;

a drain pump housing configured to allow washing water drained from the tub to flow therethrough; and, a drain pump motor that causes washing water in the drain pump housing to flow, wherein the drain pump housing and the drain pump motor are fastened to each other, wherein a plurality of fastening protrusions formed at one of the drain pump housing and the drain pump motor are inserted into a plurality of fastening grooves formed at the other of the drain pump housing and the drain pump motor, and wherein a length of one of the plurality of fastening protrusions in an extended directions of the fastening protrusions is different from lengths of the other fastening protrusions, or a length of one space between two neighboring fastenings is different from lengths of the other spaces between the other two neighboring fastenings.

2. The laundry treating machine according to claim 1, wherein the drain pump housing includes:

an inlet pipe through which washing water in the tub is introduced;

an outlet pipe through which washing water is drained to an outside;

a housing body connects the inlet pipe and the outlet pipe, and has an opening at a front side thereof to which the drain pump motor is connected; and the plurality of fastening protrusions protruded outward in a radial direction along an outer circumference of the opened front side of the housing body.

3. The laundry treating machine according to claim 2, wherein a plurality of protrusion grooves of the housing body are formed between the plurality of fastening protrusions at the housing body, without protruding outward in radial direction from the outer circumference of the opened front side and, a length of one protrusion groove of the plurality of protrusion grooves formed along the outer circumference of the housing body is different from lengths of the other protrusion grooves.

4. The laundry treating machine according to claim 2, wherein the drain pump housing includes:

a first stopper that limits rotation of the fastening protrusion in a direction of inserting the fastening protrusion into the fastening groove by touching one edge of the fastening groove; and a second stopper that limits rotation of the fastening protrusion in direction of releasing the fastening protrusion from the fastening groove by touching the other edge of the fastening groove.

5. The laundry treating machine according to claim 1, wherein the drain pump motor includes:

an impeller that rotates to discharge washing water flowing in the drain pump housing to the outside; and a terminal that connects to a power line to receive an external power, wherein the terminal is placed on an upper part of the drain pump motor when the drain pump motor and the drain pump housing are fastened to each other.

6. The laundry treating machine according to claim 1, wherein the drain pump housing includes a housing body that connects an inlet pipe and the outlet pipe, and has an opening at a front side of the housing body to which the drain pump motor is connected, wherein the plurality of the fastening protrusions are formed at the housing body to be protruded outward in a radial direction along an outer circumference of an opened front side of the housing body, and a plurality of protrusion grooves are formed between the plurality of fastening protrusions without being protruded outward in the radial direction from the outer circumference of the opened front side of the housing body, wherein the drain pump motor includes a plurality of seat portions on which the plurality of fastening protrusions are seated, wherein the plurality of fastening grooves are formed at the drain pump motor, wherein the plurality of protrusion grooves are seated on and the plurality of the fastening protrusions are inserted into the plurality of the fastening grooves.

7. The laundry treating machine according to claim 6, wherein a length of one of the protrusion grooves is different from lengths of the other protrusion grooves, wherein the length is a length of a protrusion groove formed along the circumference of the housing body, and each of the plurality of fastening grooves is formed to have a length such that a corresponding protrusion groove can be seated on.

8. The laundry treating machine according to claim 6, wherein a length of one of the plurality of fastening protrusions is different from lengths of the other fastening protrusions, wherein the length is a length extended along the circumference of the housing body, and each of the plurality of seat portions is formed to have a length such that a corresponding fastening protrusions can be seated on the seat portion.

9. The laundry treating machine according to claim 6, wherein a thickness of one of the fastening protrusions is different from thicknesses of the other fastening protrusions, and each of the plurality of fastening grooves is formed to have the thickness such that a corresponding fastening protrusion is inserted into a corresponding fastening groove.

10. The laundry treating machine that includes:

a case;

a tub disposed in the case for containing washing water;

a drum rotatably disposed in the tub;

a drain pump housing configured to allow washing water drained from the tub to flow therethrough;

a drain pump motor that causes washing water in the drain pump housing to flow; and a terminal placed at a side of the drain pump motor to receive an external power, wherein the drain pump housing and the drain pump motor are fastened to each other, wherein a plurality of fastening protrusions are formed at one of the drain pump housing and the drain pump motor are inserted into a plurality of fastening grooves formed at the other of the drain pump housing and the drain pump motor, wherein the plurality of fastening protrusions and the plurality of fastening grooves are formed such that each of the fastening protrusions is inserted into a corresponding fastening groove to place the terminal in a predetermined position when the drain pump motor and the drain pump housing are fastened to each other.

11. The laundry treating machine according to claim 10, wherein a plurality of seat portions on which the plurality of fastening protrusions are seated are formed between the plurality of fastening grooves, and the plurality of fastening protrusions and the plurality of seat portions are formed such that each of fastening protrusions is seated on a predetermined seat portion.

* * * * *